US006702180B2

(12) United States Patent
Hsu

(10) Patent No.: US 6,702,180 B2
(45) Date of Patent: Mar. 9, 2004

(54) STEREOSCOPIC INNER SPACER

(75) Inventor: Fong-Ling Hsu, Pa Te (TW)

(73) Assignee: Quanta Computer Inc., Taoyuan Hsien (TW)

( * ) Notice: Subject to any disclaimer, the term of this patent is extended or adjusted under 35 U.S.C. 154(b) by 18 days.

(21) Appl. No.: 10/252,097

(22) Filed: Sep. 23, 2002

(65) Prior Publication Data

US 2004/0000583 A1 Jan. 1, 2004

(30) Foreign Application Priority Data

Jun. 28, 2002 (TW) ..... 91209873 U

(51) Int. Cl.[7] ..... B65D 5/496

(52) U.S. Cl. ..... 229/120.28; 229/120.26; 229/120.29

(58) Field of Search ..... 229/120.24, 120.38, 229/120.26, 120.29, 120.37

(56) References Cited

U.S. PATENT DOCUMENTS 2,596,205 A * 5/1952 Buttery ..... 229/120.26
2,620,118 A * 12/1952 Lillie ..... 229/120.29
2,738,917 A * 3/1956 Mader ..... 229/120.29
3,236,433 A * 2/1966 Barrett ..... 229/120.26
3,301,460 A * 1/1967 Harrison ..... 229/120.26
3,519,191 A * 7/1970 Royce ..... 229/120.29
3,963,169 A * 6/1976 Gardner ..... 229/120.29
4,155,501 A * 5/1979 Young ..... 229/120.26
4,157,157 A * 6/1979 Young ..... 229/120.29

* cited by examiner

*Primary Examiner*—Tri M. Mai
(74) *Attorney, Agent, or Firm*—Hoffman, Wasson & Gitler, P.C.

(57) ABSTRACT

A stereoscopic inner spacer composed of paper materials is disclosed, and the stereoscopic inner spacer is made by using crossing and folding. The stereoscopic inner spacer is put in a packaging carton to provide objects supporting and holding, thereby preventing the objects from damage caused by impacts. Furthermore, the stereoscopic inner spacer has many partitions and is adapted to pack various components having the approximated sizes, thereby preventing the objects from intermixing and avoiding the objects from damage resulted from colliding mutually.

20 Claims, 2 Drawing Sheets

STEREOSCOPIC INNER SPACER

FIELD OF THE INVENTION

The present invention relates to a stereoscopic inner spacer, and more particularly, to a stereoscopic inner spacer implemented inside a packaging carton to provide the support and protection of the objects therein.

BACKGROUND OF THE INVENTION

Inside most of the daily-used packaging cartons, there are protective packaging structures existing to support and protect the objects disposed in the packaging cartons, thereby avoiding damage resulted from external impact. Inside the commonly-used packaging cartons, the frequently-used materials forming the protective packaging structures are, such as plastic, paper, and metal, etc., wherein paper is quite popularly selected for manufacturing the packaging structures due to the advantages of easily processing, low technical threshold, low cost, and easily being printed on.

Nevertheless, comparing to materials of plastic or metal, the impact-resistibility and water-resistibility of the packing structures made of paper are insufficient. Moreover, for highly precise and fairly fragile electrical components, since they are quite easy to be damaged during transportation by external interference, such as water, dust, impact and so on, the requirements for the packaging structure are stricter. To reduce the damage to objects during transportation, the capabilities, such as waterproof, dust-proof, and shockproof, have been equipped by the protective packaging structure essentially. Currently, the relative popular method is to insert lots of inner spacers, paper or plastic lining materials, foamed plastic fillers, or foamed cushioning pads, etc. into a packaging carton, so as to not only effectively separate the objects therein for preventing damages caused by collision, but also provide the objects therein extra protection for avoiding the impact caused by shaking during transportation.

In addition, based on the principle of environment protection, the packaging structures of paper can be produced by reprocessed paper pulp and be recycled. Moreover, unlike other materials, paper materials do not need to bear the cost of recycling. Therefore, the utilization of paper materials can reduce the impact to ecological environment and have the advantage of low cost.

Presently, the fabrication technique of paper packaging structures by directly hot pressing paper pulp into a mold is quite common. Another method is to cut cardboard into various planks by first sampling and drawing parallel lines according to the size of the required object; and then folding and pasting the planks according to the required style to fabricate the inner spacer required.

However, the producing method of packaging structures by directly hot pressing paper pulp into a mold needs to develop and fabricate the mold, so that the cost is increased. Besides, the packaging structure made by folding and pasting paper sheets has the drawbacks of poor impact-resistibility, and it takes more time to produce.

SUMMARY OF THE INVENTION

In view of the background of the present invention, the producing method of the packaging structures by using mold to hot press paper pulp needs to develop and fabricate the mold, thereby increasing the producing cost. And the packaging structures made by folding and pasting paper sheets has the drawbacks of poor impact-resistibility and the process of producing is complicated and takes time.

Accordingly, one major purpose of the present invention is to provide a stereoscopic inner spacer, which is made of paper materials, to reduce the burden of environment and fulfill the requirement of environment protection.

Another purpose of the present invention is to provide a stereoscopic inner spacer by merely folding and clasping, so as to have the advantages of easily producing; not needing to develop and fabricate molds, thus saving the cost of developing and fabricating the molds to reduce the expense.

The further purpose of the present invention is that the stereoscopic inner spacer of the present invention can be put in a packaging carton to support and hold objects, thereby preventing the objects from being damaged by impact. Additionally, the stereoscopic inner spacer has many partitions, so that the objects inside the packaging carton can be put in order and the damage caused by impact can be avoided.

According to the aforementioned purposes, the present invention further provides a stereoscopic inner spacer suitable for holding a plurality of objects in a packaging carton. The stereoscopic inner spacer comprises: a first side; a second side, wherein, between the second side and the first side, there is a first fold line; a first setting place, and, between the first setting place and the second side, there is a second fold line, wherein the first setting place comprises a first supporting portion and a second supporting portion in opposite, and, between the first setting place and the first supporting portion, there is a third fold line, and, between the first setting place and the second supporting portion, there is a fourth fold line, and the first supporting portion comprises a first clasp, and the second supporting portion comprising a second clasp; a first partition, wherein, between the first partition and the first setting place, there is a fifth fold line; a second partition, wherein the second partition comprises a first notch and a second notch, and, between the second partition and the first partition, there is a sixth fold line; a second setting place, wherein, between the second setting place and the second partition, there is a seventh fold line; a third partition, wherein, between the third partition and the second setting place, there is an eighth fold line; a fourth partition, wherein, between the fourth partition and the third partition, there is a ninth fold line; a fifth partition, wherein, between the fifth partition and the fourth partition, there is a tenth fold line; a third setting place, wherein the third setting place comprises a third supporting portion and a fourth supporting portion in opposite, and, between the third setting place and the fifth partition, there is an eleventh fold line, and, between the third setting place and the third supporting portion there is a twelfth fold line, and, between the third setting place and the fourth supporting portion there is a thirteenth fold line; a third side, wherein, between the third side and the third setting place there is a fourteenth fold line; and a fourth side, wherein, between the fourth side and the third side, there is a fifteenth fold line. By folding the first fold line, the second fold line, the third fold line, the fourth fold line, the fifth fold line, the sixth fold line, the seventh fold line, the eighth fold line, the ninth fold line, the tenth fold line, the eleventh fold line, the twelfth fold line, the thirteenth fold line, the fourteenth fold line, and the fifteenth fold line, the first clasp is stuck in the first notch, and the second clasp is stuck in the second notch, thereby forming a first room above the first setting place, a second room above the second setting place, and a third room above the third setting place, and the first room and the second room are separated by the first partition and the second partition, and the second room and the third room are separated by the third partition, the fourth partition and the fifth partition.

Because the stereoscopic inner spacer supports the objects deposited within a packaging carton, so that the objects can be protected from being damaged by impact. Additionally, the stereoscopic inner spacer has many partitions, so that the objects inside the packaging carton can be put in order and the damage caused by impact can be avoided.

Besides, the stereoscopic inner spacer of the present invention is formed by merely folding and clasping, and without using adhesive, so that production thereof is easy. During fabricating the stereoscopic inner spacer, since it is not necessary to develop and fabricate molds, the cost is reduced.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

The present invention discloses a stereoscopic inner spacer made by folding and clasping, wherein the stereoscopic inner spacer is a paper-made product and has lots of partitions, so that the stereoscopic inner spacer not only can be used to separate and support the objects inside a packaging carton, but also can prevent the objects from being damaged by impacts caused by the objects colliding to each other or from environment. In order to make the illustration of the present invention more explicitly and completely, the following description and the drawings from FIG. 1 to FIG. 3 are stated.

Figure 1:
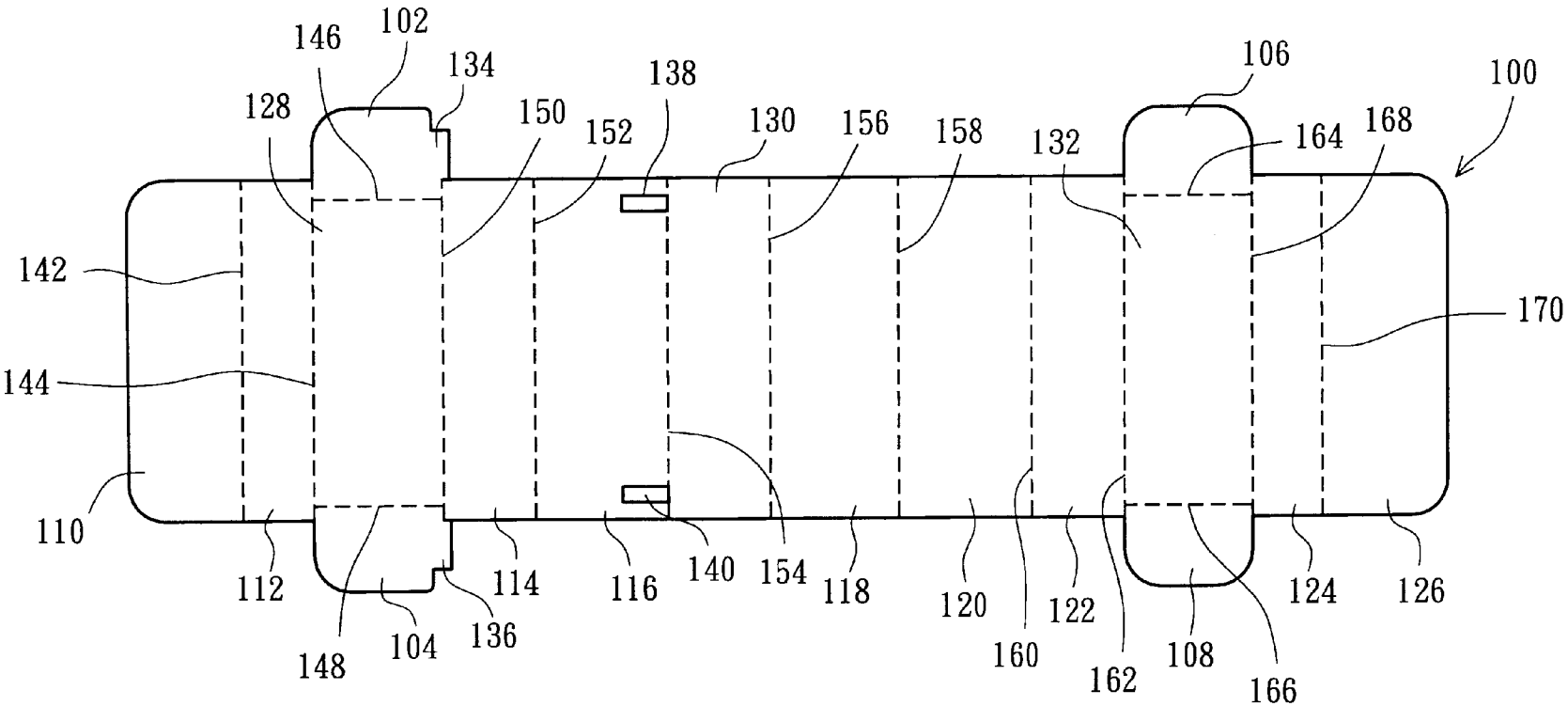
FIG. 1 illustrates a diagram showing an unfolded stereoscopic inner spacer according to a preferred embodiment of the present invention.
Figure 2:
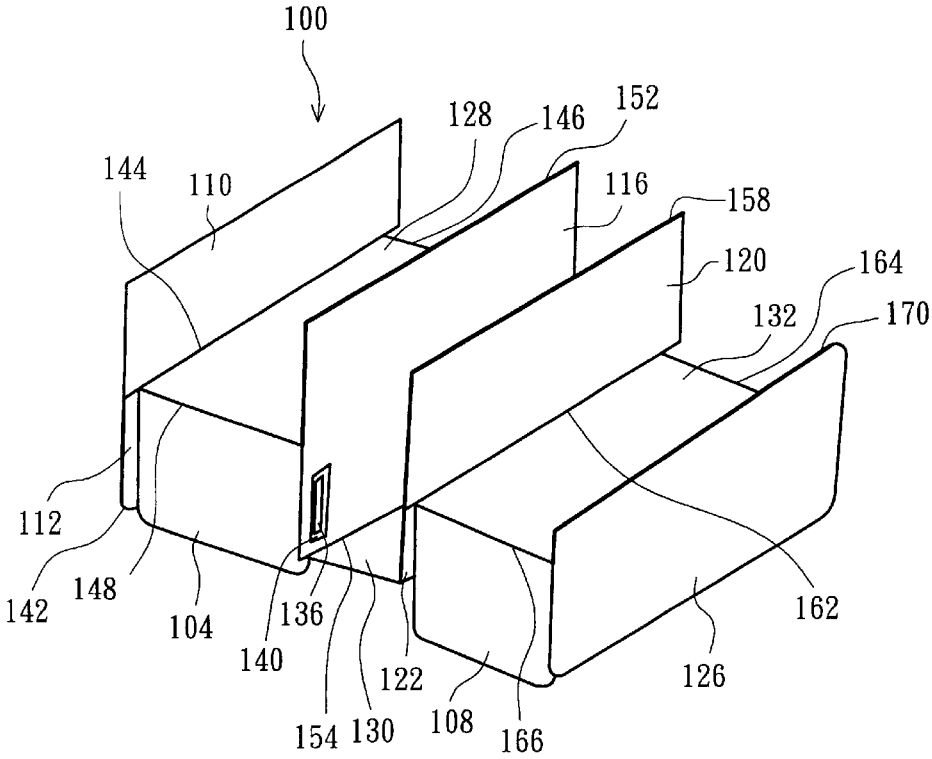
FIG. 2 illustrates a 3-D assembly diagram showing a stereoscopic inner spacer according to a preferred embodiment of the present invention.
Figure 3:
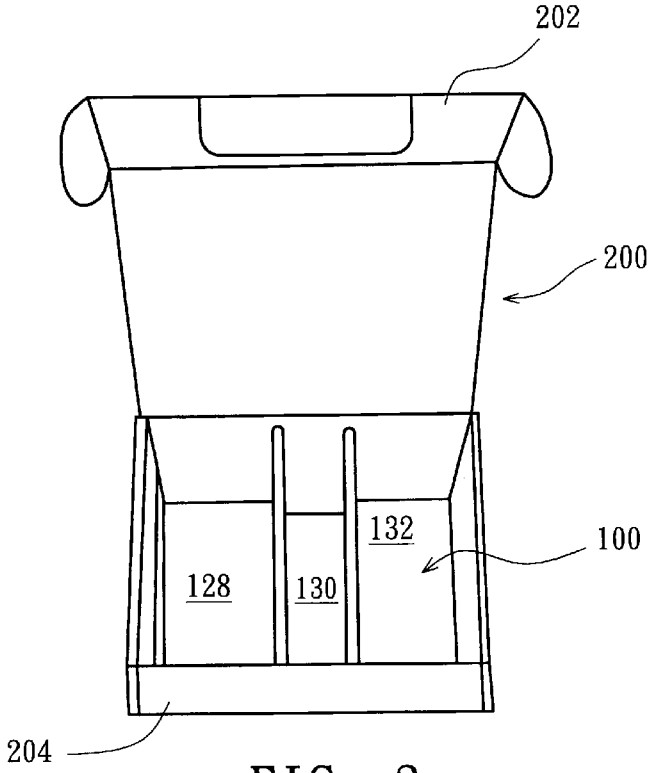
FIG. 3 illustrates a 3-D diagram showing a stereoscopic inner spacer according to a preferred embodiment of the present invention deposited within a packaging carton.

Referring to FIG. 1, FIG. 1 illustrates a diagram showing an unfolded stereoscopic inner spacer according to a preferred embodiment of the present invention, and simultaneously referring to FIG. 2, FIG. 2 illustrates a 3-D assembly diagram showing a stereoscopic inner spacer according to a preferred embodiment of the present invention. The material of the stereoscopic inner spacer 100 is preferably selected from a paper material having a buffer layer, such as corrugated paper, bond paper and so on. The stereoscopic inner spacer 100 comprises a setting place 128, a setting place 130, and a setting place 132 used to support objects, wherein the setting place 128, the setting place 130, and the setting place 132 can be a rectangle, for example. One side of the setting place 128 is a folding structure formed by a side 112 and a side 110. In opposition to the combination of the side 112 and the side 110, there is another folding structure on another side of the setting place 128, which is formed by a partition 114 and a partition 116, wherein, between the setting place 128 and the side 112, there is a fold line 144; between the side 112 and the side 110, there is a fold line 142; between the setting place 128 and the partition 114, there is a fold line 150; and between the partition 114 and the partition 116, there is a fold line 152. By folding the fold line 142, the fold line 144, the fold line 150, and the fold line 152, the side 110, the upper of the setting place 128, and the partition 114 form, for example, a cuboid open room, and the cuboid open room can be used to deposit an object preferably having the size approximate to that of the cuboid open room. Besides, the other two sides of the setting place 128 are a supporting portion 102 and a supporting portion 104 in opposition, wherein, between the supporting portion 102 and the setting place 128, there is a fold line 146; and between the supporting portion 104 and the setting place 128, there is a fold line 148. Additionally, the supporting portion 102 further comprises a clasp 134, and the supporting portion 104 comprises a clasp 136, and the partition 116 comprises a notch 138 and a notch 140 corresponding to the clasp 134 and the clasp 136 respectively. By folding the fold line 142, the fold line 144, the fold line 146, the fold line 148, the fold line 150, and the fold line 152, the clasp 134 is stuck in the notch 138, and the clasp 136 is stuck in the notch 140, thereby forming, for example, a cuboid room by the bottom of the setting place 128, the supporting portion 102, the supporting portion 104, the side 112, and the partition 116 can be used to deposit an object preferably having the size approximate to that of the cuboid room.

In addition, one side of a setting place 130 is a folding partition structure formed by the partition 114 and the partition 116. In opposition to the combination of the partition 114 and the partition 116, there is another folding partition structure on another side of the setting place 130, which is formed by a partition 118, a partition 120, and a partition 122, wherein, between the setting place 130 and the partition 116, there is a fold line 154; between the setting place 130 and the partition 118, there is a fold line 156; between the partition 118 and the partition 120, there is a fold line 158; and between the partition 120 and the partition 122, there is a fold line 160. By folding the fold line 154, the fold line 156, the fold line 158, and the fold line 160, the upper of the setting place 130, the partition 116, and the partition 118 form, for example, a cuboid open room, and the cuboid open room can be used to deposit an object preferably having the size approximate to that of the cuboid open room.

One side of a setting place 132 is a folding partition structure formed by the partition 118, the partition 120, and the partition 122. In opposition to the folding combination of the partition 118, the partition 120, and the partition 122, there is another folding partition structure on another side of the setting place 132, which is formed by a side 124 and a side 126, wherein, between the setting place 132 and the partition 122 there is a fold line 162; between the setting place 132 and the side 124, there is a fold line 168; and between the side 124 and the side 126, there is a fold line 170. Besides, the other two sides of the setting place 132 are a supporting portion 106 and a supporting portion 108 in opposition, wherein, between the supporting portion 106 and the setting place 132, there is a fold line 164; and between the supporting portion 108 and the setting place 132, there is a fold line 166. By folding the fold line 158, the fold line 160, the fold line 162, the fold line 164, the fold line 166, the fold line 168, and the fold line 170, the upper of the setting place 132, the partition 120, and the side 124 form, for example, a cuboid open room, and the cuboid open room can be used to deposit an object preferably having the size approximate to that of the cuboid open. The bottom of the setting place 132, the partition 122, the supporting portion 106, the supporting portion 108, and the side 126 form, for example, a cuboid room, and the cuboid room can be used to deposit an object preferably having the size approximate to that of the cuboid room.

After folding all fold lines of the stereoscopic inner spacer 100 and sticking the clasp 134 and the clasp 136 into the notch 138 and the notch 140 respectively, a structure of the stereoscopic inner spacer 100 shown in FIG. 2 is formed. Furthermore, the fabrication of the stereoscopic inner spacer 100 can only use the clasp 134 and the clasp 136 to fabricate, or can use paste to paste up the partition folding structure and the side folding structure. The setting place 128, the setting place 130, and the setting place 132 can be in the same height, or in different heights, and the heights of the setting place 128, the setting place 130, and the setting place 132 can be changed according to the packaging actual needs. In one preferred embodiment of the present invention, the height of the setting place 130 is lower than the height of the setting place 128 and the height of the setting place 132, and there is no room provided for depositing objects under the setting place 130. However, the present invention is not limited to the aforementioned description, and the present invention can also lift the height of the setting place 130 to provide a room for depositing objects. Besides, the sizes and the shapes of the setting place 128, the setting place 130, and the setting place 132 can be changed according to the packaging actual needs without limiting the aforementioned description. Additionally, in the present invention, the rooms under the setting place 128 and the setting place 132, formed by the supporting portion 102 and the supporting portion 104, and the supporting portion 106 and the supporting portion 108 respectively, not only can be used to deposit objects, but also can provide impact-resistibility for a better cushioning effect. For example, a stereoscopic inner spacer of a preferred embodiment of the present invention can sustain an impact caused by the 50-gram stereoscopic inner spacer falling down from a height of 90 centimeters with a velocity of 11 meters per second.

Referring to FIG. 3, FIG. 3 illustrates a 3-D diagram showing a stereoscopic inner spacer according to a preferred embodiment of the present invention deposited within a packaging carton. A packaging carton 200 comprises a lid 202 and a carton body 204. After the fabrication is completed, the stereoscopic inner spacer 100 shown in FIG. 2 is put into the carton body 204 with corresponding sizes of the packaging carton 200. With elasticity characteristic of the folding paper sheets, the stereoscopic inner spacer 100 can be embedded inside the carton body 204 smoothly. In FIG. 3, the cuboid open rooms above the setting place 128, and the setting place 130, and the setting place 132 can be used to deposit different objects. For example, a portable communication equipment can be put on the setting place 128; a power cord of the portable communication equipment can be put on the setting place 130; and a battery charger of the portable communication equipment can be put on the setting place 132. The foregoing example is an illustration of the present invention rather than a limitation of the present invention, and the amounts of the partitions and the sizes of the setting rooms of the stereoscopic inner spacer of the present invention can be changed according to the actual needs of packaging goods, and it is preferably to make the amounts of partitions equal to the amounts of objects desired to be packaged, and make the size of each setting room slightly larger than that of the object desired to be packaged.

According to the aforementioned description, one advantage of the present invention is to provide a new structural stereoscopic inner spacer having lots of partition structures that can be used to deposit various components. Therefore, the stereoscopic inner spacer of the present invention is very convenient.

Another advantage of the present invention is that the stereoscopic inner spacer of the present invention can be fabricated by folding and using clasp structures without using adhesive, thereby easily producing and not needing to develop and fabricate molds, therefore the cost of developing and fabricating the modes is saved to reduce the expense.

A further advantage of the present invention is that the stereoscopic inner spacer is made of paper materials, so that the burden from environment protection can be reduced to fulfill the requirements of protecting the environment.

As is understood by a person skilled in the art, the foregoing preferred embodiments of the present invention are illustrated of the present invention rather than limiting of the present invention. It is intended to cover various modifications and similar arrangements included within the spirit and scope of the appended claims, the scope of which should be accorded the broadest interpretation so as to encompass all such modifications and similar structure.

What is claimed is:

1. A stereoscopic inner spacer, suitable for supporting a plurality of objects in a packaging carton, and the stereoscopic inner spacer comprises:

a first side;

a first setting place, wherein, between the first setting place and the first side, there is a first fold line;

a first partition, wherein the first partition comprises a first notch and a second notch, and between the first partition and the first setting place, there is a second fold line, and, the first side, the first setting place, and the first partition constitute a first room;

a second setting place, wherein between the second setting place and the first partition, there is a third fold line;

a second partition, wherein between the second partition and the second setting place, there is a fourth fold line, and, the first partition, the second setting place, and the second partition constitute a second room;

a third setting place, wherein between the third setting place and the second partition, there is a fifth fold line;

a second side, wherein between the second side and the third setting place, there is a sixth fold line, and, the second partition, the third setting place, and the second side constitute a third room;

a first supporting portion, wherein the first supporting portion comprises a first clasp, and between the first supporting portion and the first setting place, there is a seventh fold line, and the first clasp is stuck in the first notch; and a second supporting portion, wherein the second supporting portion comprises a second clasp, and between the second supporting portion and the first setting place, there is an eighth fold line, and the second clasp is stuck in the second notch.

2. The stereoscopic inner spacer according to claim 1, further comprises a third supporting portion and a fourth supporting portion, and between the third supporting portion and the third setting place, there is a ninth fold line, and between the fourth supporting portion and the third setting place, there is a tenth fold line.

3. The stereoscopic inner spacer according to claim 2, wherein by folding the ninth fold line and the tenth fold line, the third supporting portion and the fourth supporting portion constitute a supporting structure to support the third setting place.

4. The stereoscopic inner spacer according to claim 2, wherein the third setting place, the third supporting portion, the fourth supporting portion, the second side, and the second partition constitute a fourth room, and the fourth room is used to deposited the objects.

5. The stereoscopic inner spacer according to claim 1, wherein the material of the stereoscopic inner spacer is a paper material having a buffer layer.

6. The stereoscopic inner spacer according to claim 1, wherein by folding the seventh fold line and the eighth fold line, the first supporting portion and the second supporting portion form another supporting structure to support the first setting place.

7. The stereoscopic inner spacer according to claim 1, wherein the first setting place, the first supporting portion, the second supporting portion, the first side, and the first partition constitute a fifth room, and the fifth room is used to deposit the objects.

8. A stereoscopic inner spacer, suitable for supporting a plurality of objects in a packaging carton, and the stereoscopic inner spacer comprises:

a first side;

a second side, wherein between the second side and the first side, there is a first fold line;

a first setting place, and between the first setting place and the second side, there is a second fold line, wherein the first setting place comprises a first supporting portion and a second supporting portion in opposite, and between the first setting place and the first supporting portion, there is a third fold line, and between the first setting place and the second supporting portion, there is a fourth fold line, and the first supporting portion comprises a first clasp, the second supporting portion comprising a second clasp;

a first partition, wherein between the first partition and the first setting place, there is a fifth fold line;

a second partition, wherein the second partition comprising a first notch and a second notch, and between the second partition and the first partition, there is a sixth fold line;

a second setting place, wherein between the second setting place and the second partition, there is a seventh fold line;

a third partition, wherein between the third partition and the second setting place, there is an eighth fold line;

a fourth partition, wherein between the fourth partition and the third partition, there is a ninth fold line;

a fifth partition, wherein between the fifth partition and the fourth partition, there is a tenth fold line;

a third setting place, wherein the third setting place comprises a third supporting portion and a fourth supporting portion in opposite, and between the third setting place and the fifth partition, there is an eleventh fold line, and between the third setting place and the third supporting portion, there is a twelfth fold line, and between the third setting place and the fourth supporting portion, there is a thirteenth fold line;

a third side, wherein between the third side and the third setting place, there is a fourteenth fold line; and a fourth side, wherein between the fourth side and the third side, there is a fifteenth fold line, and by folding the first fold line, the second fold line, the fifth fold line, the sixth fold line, the seventh fold line, the eighth fold line, the ninth fold line, the tenth fold line, the eleventh fold line, the fourteenth fold line, and the fifteenth fold line, the first clasp is stuck in the first notch, and the second clasp is stuck in the second notch, thereby forming a first room above the first setting place, a second room above the second setting place, and a third room above the third setting place, and the first room and the second room are separated by the first partition and the second partition, the second room and the third room are separated by the fourth partition and the fifth partition.

9. The stereoscopic inner spacer according to claim 8, wherein the material of the stereoscopic inner spacer is a paper material having a buffer layer.

10. The stereoscopic inner spacer according to claim 8, wherein the material of the stereoscopic inner spacer is selected from a group consisting of corrugated paper and bond paper.

11. The stereoscopic inner spacer according to claim 8, wherein by folding the third fold line and the fourth fold line, the first supporting portion and the second supporting portion constitute a supporting structure to support the first setting place.

12. The stereoscopic inner spacer according to claim 8, wherein by folding the third fold line and the fourth fold line, the first setting place, the first supporting portion, the second supporting portion, the second side, and the second partition constitute a fourth room to deposit the objects.

13. The stereoscopic inner spacer according to claim 8, wherein by folding the twelfth fold line and the thirteenth fold line, the third supporting portion and the fourth supporting portion constitute another supporting structure to support the third setting place.

14. The stereoscopic inner spacer according to claim 8, wherein by folding the third fold line and the fourth fold line, the third setting place, the third supporting portion, the fourth supporting portion, the fifth partition, and the fourth side constitute a fifth room to deposit the objects.

15. A packaging installation used to package a plurality of objects, comprising:

a packaging carton; and a stereoscopic inner spacer corresponding to the packaging carton, wherein the stereoscopic inner spacer is used to support the objects, and the stereoscopic inner spacer comprises:

a first side;

a first setting place, wherein between the first setting place and the first side, there is a first fold line;

a first partition, wherein the first partition comprises a first notch and a second notch, and between the first partition and the first setting place, there is a second fold line, and the first side, the first setting place, and the first partition constitute a first room;

a second setting place, wherein between the second setting place and the first partition, there is a third fold line;

a second partition, wherein between the second partition and the second setting place, there is a fourth fold line, and the first partition, the second setting place, and the second partition constitute a second room;

a third setting place, wherein between the third setting place and the second partition, there is a fifth fold line;

a second side, wherein between the second side and the third setting place, there is a sixth fold line, and the second partition, the third setting place, and the second side constitute a third room;

a first supporting portion, wherein the first supporting portion comprises a first clasp, and between the first supporting portion and the first setting place, there is a seventh fold line, and the first clasp is struck in the first notch; and a second supporting portion, wherein the second supporting portion comprises a second clasp, and between the second supporting portion and the first setting place, there is an eighth fold line, and the second clasp is stuck in the second notch.

16. The packaging installation according to claim 15, wherein the stereoscopic inner spacer further comprises a third supporting portion and a fourth supporting portion, and between the third supporting portion and the third setting place, there is a ninth fold line, and between the fourth supporting portion and the third setting place, there is a tenth fold line, by folding the ninth fold line and the tenth fold line, the third supporting portion and the fourth supporting portion form a supporting structure to support the third setting place.

17. The packaging installation according to claim 16, wherein the third setting place, the third supporting portion, the fourth supporting portion, the second side, and the second partition form a fourth room, and the fourth room can be used to deposit the objects.

18. The packaging installation according to claim 15, wherein the material of the stereoscopic inner spacer is a paper material having a buffer layer.

19. The packaging installation according to claim 15, wherein by folding the seventh fold line and the eighth fold line, the first supporting portion and the second supporting portion form another supporting structure to support the first setting place.

20. The packaging installation according to claim 15, wherein the first setting place, the first supporting portion, the second supporting portion, the first side, and the first partition form a fifth room, and the fifth room can be used to deposit the objects.

* * * * *